United States Patent [19]

Saito et al.

[11] Patent Number: 5,052,917

[45] Date of Patent: Oct. 1, 1991

[54] DOUBLE-COMBUSTOR TYPE PULSATING COMBUSTION APPARATUS

[75] Inventors: Kazuo Saito, Fujisawa; Ichiro Hongo, Yokohama, both of Japan

[73] Assignee: Kabushiki Kaisha Toshiba, Kawasaki, Japan

[21] Appl. No.: 568,060

[22] Filed: Aug. 16, 1990

[30] Foreign Application Priority Data

Aug. 22, 1989 [JP] Japan ..... 1-214045

[51] Int. Cl.[5] ..... F23C 11/04

[52] U.S. Cl. ..... 431/1

[58] Field of Search ..... 431/1

[56] References Cited

U.S. PATENT DOCUMENTS 3,447,878 6/1969 Haag et al. .
4,840,558 6/1989 Saito et al. ..... 431/1
4,917,596 4/1990 Saito .
4,946,381 8/1990 Saito et al. ..... 431/1

FOREIGN PATENT DOCUMENTS 74410 4/1984 Japan ..... 431/1
207812 10/1985 Japan ..... 431/1
46513 2/1989 Japan ..... 431/1

OTHER PUBLICATIONS

Proceedings of Symposium on Pulse-Combustion Applications; B. S. Sran and J. A. C. Kentfield; paper No. 3, Mar. 1982, 14 pages.

*Primary Examiner*—Carroll B. Dority
*Attorney, Agent, or Firm*—Cushman, Darby & Cushman

[57] ABSTRACT

A double-combustor type pulsating combustion apparatus has a pair of pulsating combustors. Fuel-supplying valves are respectively provided in fuel-supplying pipes connected to the upstream sides of combustion chambers of the pair of pulsating combustors. A combustion control unit controls to stop only one pulsating combustor and to operate only the other pulsating combustor by closing one fuel-supplying valve corresponding to one pulsating combustor in a combustion range of ½ or less of the maximum combustion amount of the double-combustor type pulsating combustion apparatus. The combustion control unit further controls to operate both the pulsating combustors by opening both the fuel-supplying valves in a combustion range exceeding ½ of the maximum combustion amount.

9 Claims, 6 Drawing Sheets

DOUBLE-COMBUSTOR TYPE PULSATING COMBUSTION APPARATUS

BACKGROUND OF THE INVENTION

1. Field of the Invention

The present invention relates to a double-combustor type pulsating combustion apparatus for combusting a pair of pulsating combustors in reverse phase to each other.

2. Description of the Related Art

A coupling type pulsating combustion apparatus which solves a problem of noise of the defect of a pulsating combustion apparatus using one pulsating combustor is known. The apparatuses of this type are disclosed, for example, in U.S. Pat. Nos. 4,840,558 and 4,917,596. The apparatus of this type ordinarily comprises, in addition to a pair of combustion chambers formed in the same arrangement for combusting mixture gas of fuel and combustion air in a pulsating manner, tail pipes connected to the exhaust ports of the combustion chambers for exhausting exhaust gases, air-intake pipes connected at one end to the air-intake ports of the combustion chambers for supplying air necessary for combustion to the combustion chambers, an air-intake chamber connected commonly at the other end of the air-intake pipes, an exhaust chamber connected commonly at the downstream side of the tail pipes, aerodynamic valves provided in the air-intake pipes, having larger backward flow efficiency than forward flow efficiency, a fuel-supplying system for supplying fuel between the aerodynamic valves and the air-intake ports in the air-intake pipes, ignitors provided in the combustion chambers for igniting the mixture gas supplied into the combustion chambers at the time of starting, and an air-supplying fan having a small capacity, provided in or at the upstream side of the air-intake chamber.

In the coupling type pulsating combustion apparatus in which the aerodynamic valves are interposed in the air-intake pipes, the pressures in the two combustion chambers can be strongly interfered through two aerodynamic valves. Thus, the oscillating periods of the pulsating combustors can be differentiated at 180 degrees to reduce its noise.

As disclosed in U.S. patent application Ser. No. 437,187, now U.S. Pat. No. 4,946,381, filed by the inventors including ones of the present invention, a combustion amount can be varied to approx. ⅓ of the maximum combustion amount by varying the rotating speed of the air-supplying fan in response to the supplying amount of fuel at the time of operation.

However, when the coupling type pulsating combustion apparatus disclosed as above is applied, for example, for a domestic room heater, a request for further reducing room heating capacity is strongly desired due to advancement in high heat insulation and high density in residence. However, in the apparatus described above, the request for the further reduction in the room heating capacity cannot be coped with the combustion amount of approx. ⅓ of the maximum combustion amount.

In order to reduce the combustion amount to ⅓ or less of the maximum combustion amount, a method of controlling on/off a coupling type pulsating combustion apparatus is, for example, considered. However, in this manner, there arise problems of repetitive thermal stress, increase in CO concentration in combustion gas, and frosting due to condensation in a coupling type pulsating combustion apparatus by frequent on/off of a solenoid valve.

That is, in the conventional coupling type pulsating combustion apparatus, the varying range of the combustion amount cannot be reduced to ⅓ or less of the maximum combustion amount, and it cannot be applied to an equipment necessary for a large capacity varying range for domestic room heaters, etc.

SUMMARY OF THE INVENTION

Accordingly, it is an object of the present invention to provide a double-combustor type pulsating combustion apparatus in which varying range of a combustion amount can be increased.

According to one aspect of the present invention, there is provided a double-combustor type pulsating combustion apparatus comprising:

a first pulsating combustor having a first combustion chamber including a predetermined volume, a first tail pipe connected to a downstream side of the first combustion chamber, a first air-intake pipe connected to an upstream side of the first combustion chamber, and a first fuel-supplying pipe;

a second pulsating combustor having a second combustion chamber including the predetermined volume, a second tail pipe connected to a downstream side of the second combustion chamber, a second air-intake pipe connected to an upstream the of said second combustion chamber, and a second fuel-supplying pipe, being formed in the same arrangement as the first pulsating combustor, and having a combustion cycle of reverse phase to the first pulsating combustor;

a first fuel-supplying valve, provided in the first fuel-supplying pipe, for controlling supply of fuel to the first combustion chamber of the first pulsating combustor;

a second fuel-supplying valve provided in the second fuel-supplying pipe for controlling supply of fuel to the second combustion chamber of the second pulsating combustor; and control means for controlling to operate only the second pulsating combustor by closing the first fuel-supplying valve in a combustion range of ½ or less of the maximum combustion amount of the double-combustor type pulsating combustion apparatus and to operate both the first and second pulsating combustors by opening the first and second fuel-supplying valves in a combustion range exceeding ½ of the maximum combustion amount.

According to another aspect of the present invention, there is provided a double-combustor type pulsating combustion apparatus, comprising:

a pair of pulsating combustors connected to each other to be able to perform pulsating combustions in reverse phase; and combustion control means for combusting the pair of pulsating combustors while controlling combustion air supplying amounts in response to the amount of fuel supplied to the pair of pulsating combustors, and for controlling to stop combustion of one pulsating combustor when the combustion amount becomes a set combustion amount or less and to supply fuel and combustion air to the other pulsating combustor.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE PREFERRED EMBODIMENTS

Figure 1:
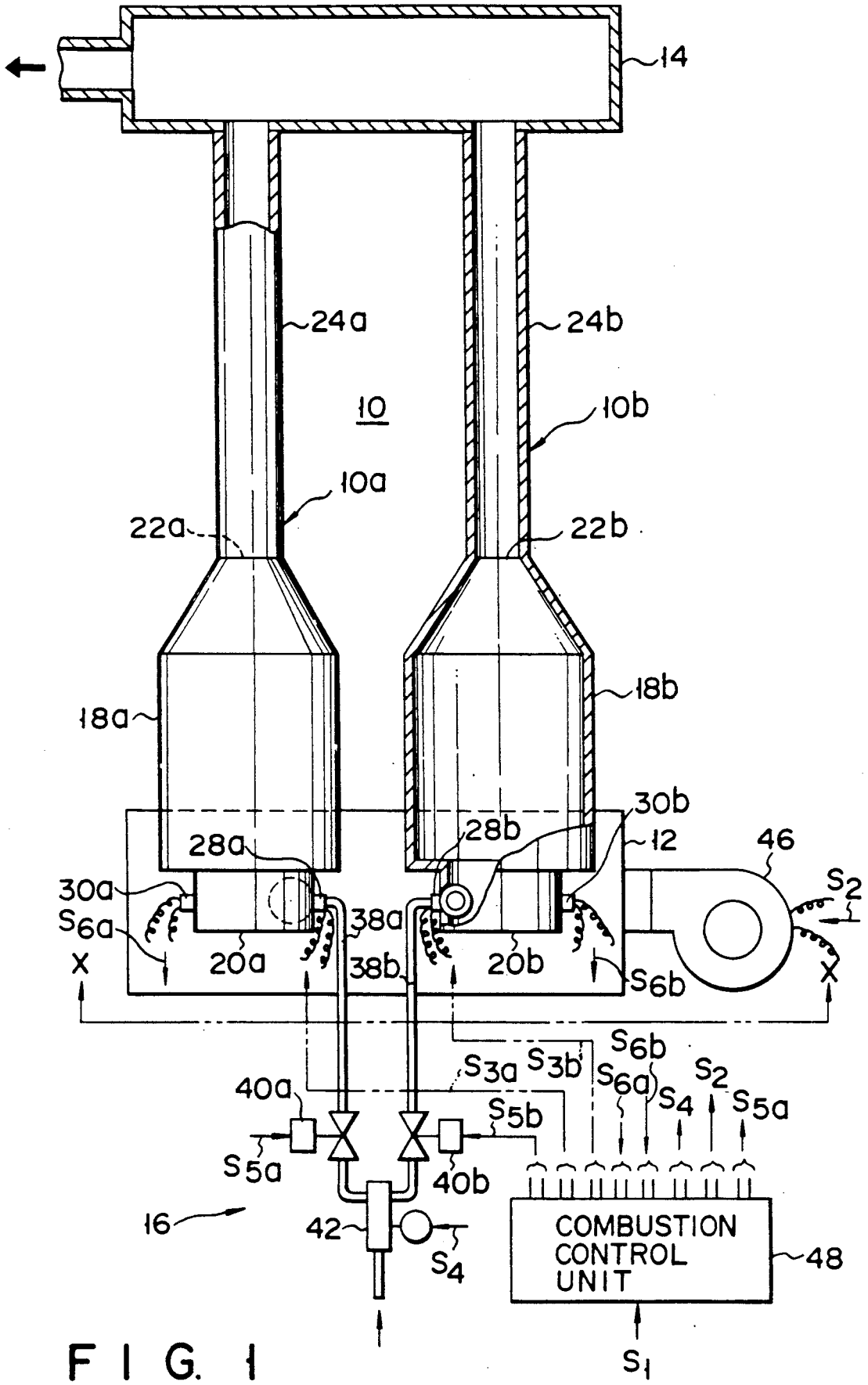
FIG. 1 is a front view partly cut out in a double-combustor type pulsating combustion apparatus according to first embodiment of the present invention.
Figure 2:
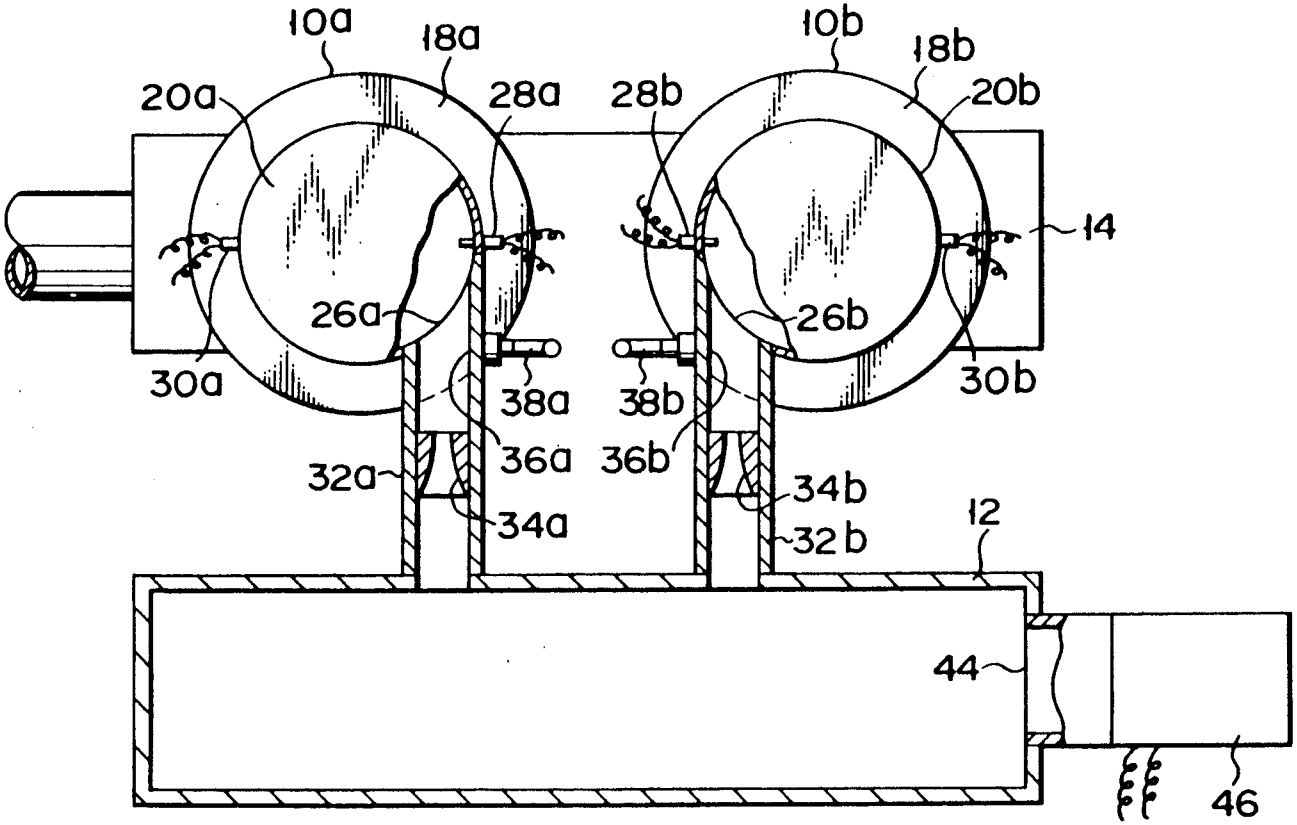
FIG. 2 is a side view partly cut out in FIG. 1 line X—X.

FIGS. 1 and 2 shows a first embodiment of a pulsating combustion apparatus 10 using a pair of pulsating combustors 10*a*, 10*b* connected in parallel with each other according to the present invention. The pulsating combustion apparatus 10 comprises a cylindrical air-intake chamber 12, an exhaust chamber 14, pulsating combustors 10*a* and 10*b* having the same arrangement and size and connected between the air-intake chamber 12 and the exhaust chamber 14, and a fuel-supplying system 16 for supplying fuel gas to the pulsating combustors 10 and 10*b*.

One pulsating combustor 10*a* has a cylindrical combustion chamber 18*a* having a bottom of which one end is closed by a closed bottom 20*a* and the other end has an exhaust port 22*a*. The exhaust port 22*a* is connected to the exhaust chamber 14 through a tail pipe 24*a*.

An air-intake port 26*a* is formed as shown in FIG. 2 in the peripheral wall of the combustion chamber 18*a* and at a position in the vicinity of the closed button 20*a*. An ignitor 28*a* with a discharge gap portion positioned within the combustion chamber 18*a* as shown in FIG. 2 is mounted in the peripheral wall of the combustion chamber 18*a* and at a position in the vicinity of the air-intake port 26*a*. A flame sensor 30*a* for detecting whether or not the mixture gas within the combustion chamber 18*a* is combusted is mounted in the peripheral wall of the combustion chamber 18*a* and at the position opposed to the ignitor 28*a*.

One end of an air-intake pipe 32*a* is connected to the air-intake port 26*a*. The other end of the air-intake pipe 32 is connected to the air-intake chamber 12. The air-intake pipe 32*a* is connected to the combustion chamber 18*a*, with the axis extending at right angle to the axis of the combustion chamber 18*a* but not intersecting therewith.

An aerodynamic valve 34*a* whose forward flow efficiency is greater than the backward flow efficiency is inserted at a position halfway of and within the air-intake pipe 32*a*. The aerodynamic valve 34*a* is in the form of a nozzle of which open area is gradually reduced from the air-intake chamber 12 toward the combustion chamber 18*a*. That is, the aerodynamic valve 34*a* is formed so as to have a small resistance with respect to a flow from the air-intake chamber 12 toward the combustion chamber 18*a* and to have a large flow resistance with respect to a flow reversed thereto.

The other pulsating combustor 10*b* has a combustion chamber 18*b*, a closed bottom 20*b*, an exhaust port 22*b*, a tail pipe 24*b*, an air-intake port 26*b*, an ignitor 28*b*, a flame sensor 30*b*, an air-intake pipe 32*b* and an aerodynamic dynamic valve 34*b*, and has the same arrangement and size as those of the pulsating combustor 10*a*.

Fuel-injection ports 36*a* and 36*b* are formed in a portion between portions where the aerodynamic valves 34*a* and 34*b* are positioned and positions connected to the air-intake ports 26*a* and 26*b* in the peripheral walls of the air-intake pipes 32*a* and 32*b*. A fuel-supplying port 38*b* is connected to the one fuel-injection port 36*a*. A fuel-supplying pipe 38*b* is connected to the other fuel-injection port 36*b*. The fuel-supplying pipe 36*a* is connected to a fuel gas supply source (not shown) through a fuel-supplying valve 40*a* composed of an electromagnetic valve and the fuel-supplying pipe 36*b* is connected to the fuel gas supply source through a fuel-supplying valve 40*b* composed of an electromagnetic valve. In this case, a fuel control valve 42 for controlling the flow rate of fuel is provided between the fuel-supplying valves 40*a*, 40*b* and the fuel gas supply source to control a combustion power of the pulsating combustion apparatus 10.

An air inlet port 44 is formed, as shown in FIG. 2, at an end in a axial direction of the air-intake chamber 12. An air-supplying fan 46 for feeding air into the air-intake chamber 12 is connected to the air inlet port 44.

First, when an operation command $S_1$ is provided from an operation unit (not shown) in response to the operation of the operation unit, a combustion control unit 48 issues a drive control command $S_2$ to the air-supplying fan 46 to rotate the fan 46 at low speed. By the start of the air-supplying fan 46, air flows through the air-intake chamber 12, the air-intake pipes 32*a*, 32*b*, the aerodynamic valves 34*a*, 34*b*, the air-intake ports 26*a*, 26*b* and the combustion chambers 18*a*, 18*b*. This air flow causes the gas remained in the combustion chambers 18*a* and 18*b* to be purged.

Next, the combustion control unit 48 provides operation start commands $S_{3a}$ and $S_{3b}$ for the ignitors 28*a* and 28*b* at different timings to start operations of the ignitors 28*a* and 28*b*, and provides an open command $S_4$ for the fuel control valve 42 to fully open the fuel control valve 42. When the fuel valves 42 is controlled to be "fully opened", the fuel gas is injected into the combustion chambers 18*a* and 18*a* through the fuel-supplying valves 40*a*, 40*b*, the fuel-supplying pipes 38*a*, 38*b* and the fuel-injection ports 36*a*, 36*b* (at that time, both the fuel-supplying valves 40*a* and 40*b* are opened by the open commands $S_{3a}$ and $S_{3b}$ from the combustion control unit 48). In this manner, the combustion chambers 18*a* and 18*b* are filled with the mixture gas of fuel gas and air. The ignitors 28*a* and 28*b* are then fired by the mixture gas because they are already in the operating state, and the pulse combustions are started in the combustion chambers 18*a* and 18*b*.

At that time, the combustion control unit 48 detects whether or not the mixture gases in the combustion chambers 18*a* and 18*b* are combusted by detection signals $S_{6a}$ and $S_{6b}$ from the flame sensors 30*a* and 30*b*. When the combustion control unit 48 detects that the mixture gases are combusted in the combustion chambers 18*a* and 18*b*, the unit 48 issues a drive control command $S_2$ to the air-supplying fan 46 to rotate the air-supplying fan 46 at a high speed. Accordingly, the air-supplying fan 46 supplies further more air into the combustion chambers 18*a* and 18*b* through the air-intake chamber 12, the air-intake pipes 32*a* and 32*b*, the aerodynamic valves 34*a*, 34*b* and the air-intake ports 26*a*, 26*b*. In this manner, more amount of air than that before the start of the fire, i.e., the combustion is supplied into the combustion chambers 18*a* and 18*b*, and stable pulsating combustion occurs therein.

Namely, the temperatures of the combustion chambers 18*a* and 18*b* are low till the mixture gases in the combustion chambers 18*a* and 18*b* are fired. Accordingly, since the pressure losses of the combustion chambers 18*a* and 18*b* are low, the air-supplying fan 46 is rotated at low speed to feed a small amount of air to the combustion chambers 18*a* and 18*b*. When the mixture gases in the combustion chambers 18*a* and 18*b* are fired, the temperatures of the combustion chambers 18*a* and 18*b* rapidly increase and the pressure losses of the combustion chambers 18*a* and 18*b* also increase. In this embodiment, however, a large amount of air is forcibly supplied after firing by the air supplying fan 46, so that the stabilized combustion may continue within the combustion chambers 18*a* and 18*b*.

Within the combustion chambers 18*a* and 18*b*, the mixture gases intermittently explosively burn. When the mixture gases are combusted in the combustion chambers 18*a* and 18*b* as described above, pressures in the combustion chambers 18*a* and 18*b* rise, and the front pressures of the fuel-injection ports 36*a* and 36*b* also rise. Therefore, the injections of fuel into the combustion chambers 18*a* and 18*b* are automatically stopped. When the pressures in the combustion chambers 18*a* and 18*b* abruptly rise, a majority of combustion gas flows toward the exhaust chamber 14 at high speed within the tail pipes 24*a* and 24*b*. The remaining combustion gases tend to flow toward the air-intake chamber 12 passing through the aerodynamic valves 34*a* and 34*b*. However, since this aerodynamic valves 34*a* and 34*b* have a great flow resistance with respect to a flow from the combustion chambers 18*a* and 18*b* toward the air-intake chamber 12, the amount of combustion gas flowing toward the air-intake chamber 12 is suppressed to a small amount.

The chambers in pressure in the combustion chambers 18*a* and 18*b* caused by the explosive combustion of the mixture gas is propagated into the air-intake chamber 12 through the aerodynamic valves 34*a* and 34*b*. This propagation increases the amount of air flowing into the combustion chambers 18*a* and 18*b* through the aerodynamic valves 34*a* and 34*b*. When the combustion gas in the combustion chambers 18*a* and 18*a* flow toward the tail pipes 24*a* and 24*b* at high speed, the pressures in the combustion chamber 18*a* and 18*a* rapidly lower to a negative pressure (less than atmospheric pressure due to the interior of the combustion gas in the tail pipes 24*a* and 24*b*.

When the pressures in the combustion chambers 18*a* and 18*a* lower to the negative pressure, the fuel injections from the fuel injection port 36*a* and 36*b* are restarted. With this, airs flow into the combustion chambers 18*a* and 18*a* through the aerodynamic valves 34*a* and 34*a* at high speed. In this case, the air flowing into the combustion chambers 18*a* and 18*a* through the aerodynamic valves 34*a* and 34*a* impinge upon the fuel gas injected from the fuel injection ports 36*a* and 36*b* and assume the form of flow which whirls along the inner surfaces of the peripheral walls of the combustion chambers 18*a* and 18*b*. Therefore, the fuel and air are well mixed. In this manner, the combustion chambers 18*a* and 18*a* are again filled with the mixture gas of fuel and air. At this time, the remaining fire is present within the combustion chambers 18*a* and 18*b*, and therefore, the mixture gas is fired by the remaining fire to again induce the explosive combustion.

Figure 3:
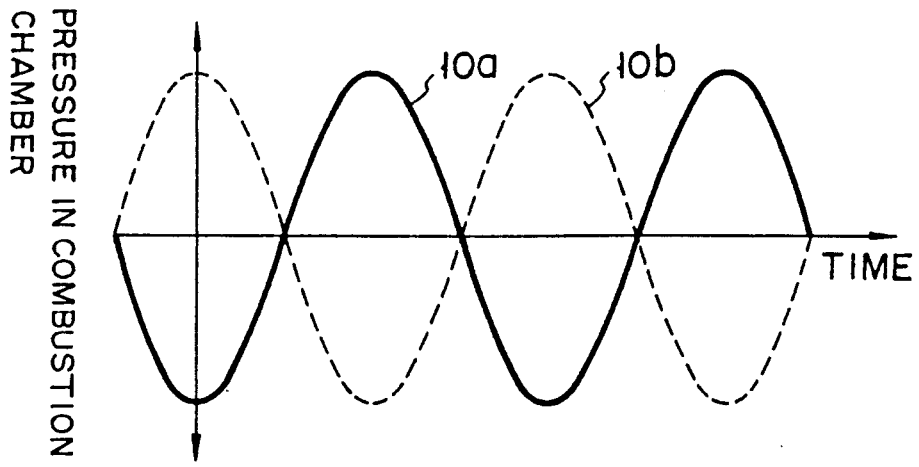
FIG. 3 is a view showing the oscillating period of pulsating combustors having phases of difference of 180 degrees at the time of stable pulsating combustion.

That is, the double combustor type pulsating combustion apparatus induces merits peculiar for the pulsating combustion by the interference of the two pulsating combustors 10*a* and 10*b* arranged in parallel with each other, i.e., (1) high heat transfer rate, (2) low NOx combustion, and (3) high load combustion, etc. by the pulsating combustion. The interference is caused by the air-intake chamber 12 and the exhaust chamber 14 connected commonly to the inlet and outlet. A noise can be reduced by repeating the pulsating combustion cycle with the phase difference of 180 degrees, i.e., in reverse phase to each other, as shown in FIG. 3. This belongs to a noise cancelling method near active control.

Figure 4:
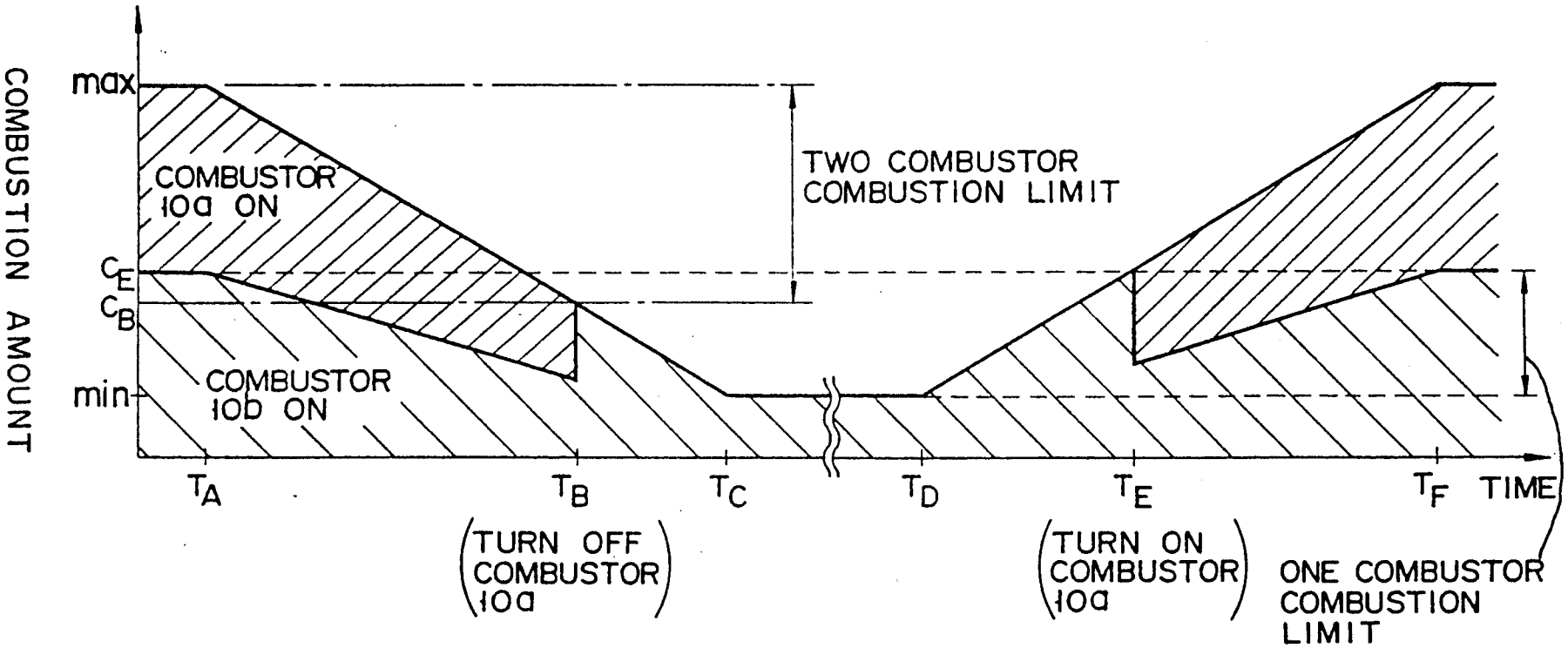
FIG. 4 is an operation characteristic diagram of pulsating combustors when a combustion amount is reduced.

Next, the reduction in the combustion amount will be described. This case includes two types of modes of the operation using two pulsating combustors 10*a* and 10*b*, and the operation only by one pulsating combustion 10*b*. That is, air supplying amount by the air-supplying fan 46 and fuel supplying amount by the fuel control valve 42 are first regulated to vary the combustion amounts of both the pulsating combustors 10*a* and 10*b* from time $T_A$ to time $T_B$ as shown in FIG. 4. When the combustion amount is reduced more than variable combustion amount range by the regulation of the air and fuel supplying amounts, one pulsating combustor 10*a* is turned off, and the operation is switched to the combustion using only the other pulsating combustor 10*b*.

An operation of this combustion will be described in more detail with reference to the processing flowcharts of the combustion control unit 48 in FIGS. 5 and 6. At time $T_A$ shown in FIG. 4, an operation command $S_1$ for varying a combustion amount is input from the operation unit (step ST1), and whether or not the operation command $S_1$ is a command for reducing the combustion amount or a command for raising the combustion amount is judged (step ST2). When the operation command $S_1$ is the command for reducing the combustion amount, whether or not the present combustion amount reaches the minimum combustion amount ($C_B$) capable by the two pulsating combustors having a combustion amount ($C_E$) or less of ½ of the maximum combustion amount (max) is judged (step ST3). If the present combustion amount does not yet arrive at the minimum combustion amount ($C_B$), the rotating speed of the air-supplying fan 46 and the opening of the fuel control valve 42 are regulated to vary the combustion amount (step ST4). In this case, the rotating speed of the air-supplying fan 46 is decelerated, and the opening of the fuel control valve 42 is reduced, thereby decreasing air and fuel supply amounts to reduce the combustion amount.

When a command for reducing a combustion amount is further received after the combustion amount reaches the minimum combustion amount ($C_B$) capable by the two pulsating combustors at time $T_B$ shown in FIG. 4, a routine for operating one pulsating combustor is executed (step ST5).

Figure 6:
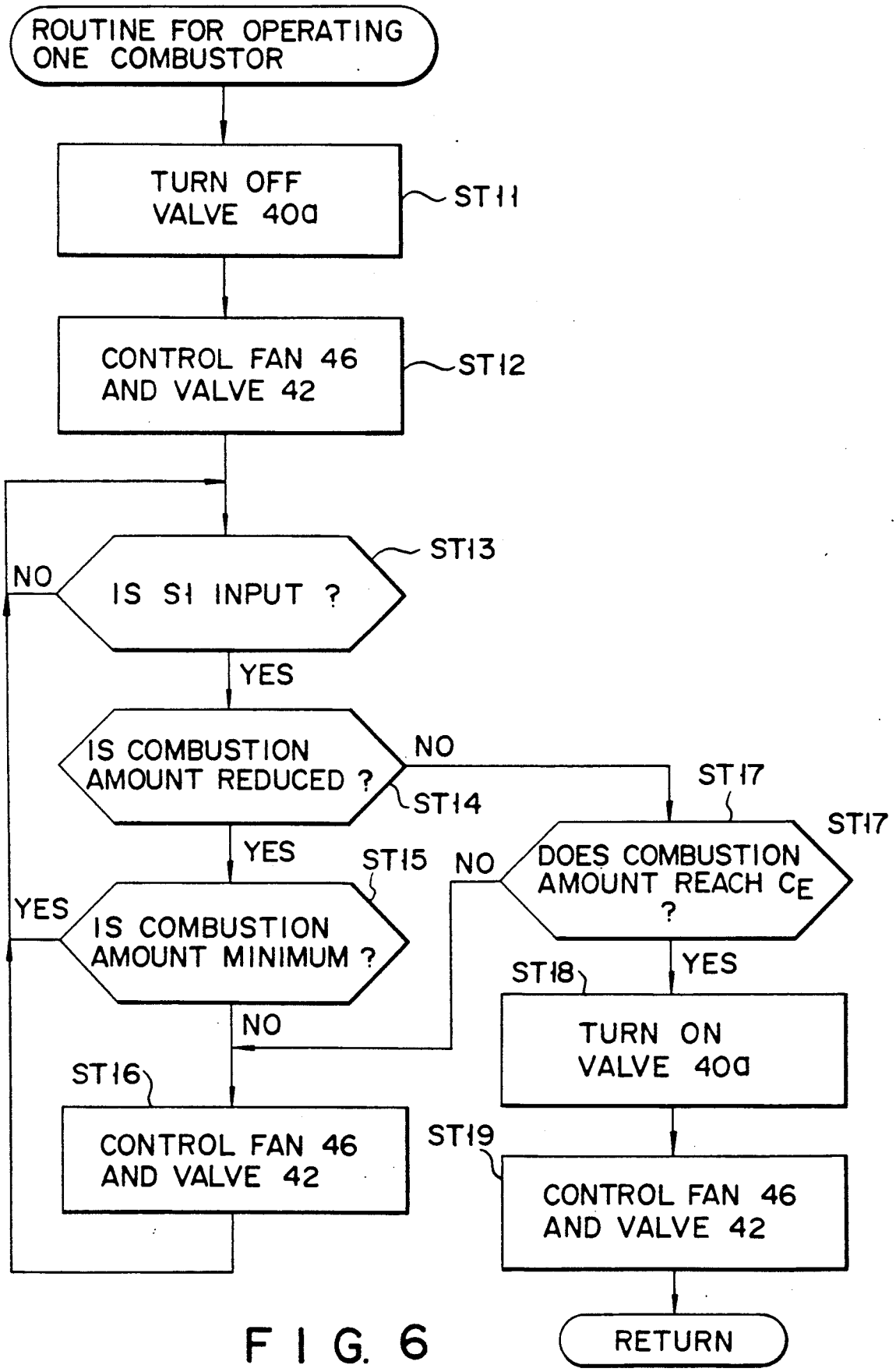
FIG. 6 is a flowchart of a routine for operating one pulsating combustor.

FIG. 6 shows a detailed flowchart of this routine for operating one pulsating combustor. In order to stop the operation of one pulsating combustor 10*a*, the fuel-supplying valve 40*a* is turned off to stop the supply of fuel to the pulsating combustor 10*a* (step ST10). Accordingly, only the pulsating combustor 10*b* is operated. At this time, the rotating speed of the air-supplying fan 46 is accelerated to a high speed, and the opening of the fuel control valve 42 is increased to increase the combustion amount of the pulsating combustor 10*b* to the combustion amount $C_B$ as shown in FIG. 4 (step ST12). In this manner, a continuous combustion variation is performed.

When a combustion amount varying operation command $S_1$ is further input (step ST13) to reduce the combustion amount (step ST14), whether or not the combustion amount reaches the minimum combustion amount (min) capable by one pulsating combustor is judged (step ST15). If the combustion amount does not yet reach the minimum combustion amount (min), the rotating speed of the air-supplying fan 46 and the opening of the fuel control valve 42 are regulated to vary the combustion amount (step ST16). In this case, the rotating speed of the air-supplying fan 46 is decelerated and the opening of the fuel control valve 42 is reduced, thereby reducing air and fuel supplying amounts to the combustion chamber 18*b* to decrease the combustion amount.

As described above, the combustion amount is reduced in response to the combustion amount reduction command, and the combustion amount reaches, for example, the minimum combustion amount (min) at time $T_C$. Since the combustion amount cannot be varied even if the combustion amount reduction command is thereafter further received, the command is ignored (step ST15).

At time $T_D$ shown, for example, in FIG. 4, when a command for increasing the combustion amount by the combustion amount varying command $S_1$ is received (step ST14), whether or not the combustion amount reaches the maximum combustion amount ($C_E$) capable by one pulsating combustor is judged (step ST17). If the combustion amount does not yet reach the maximum combustion amount ($C_E$), the rotating speed of the air-supplying fan 46 and the opening of the fuel control vale 42 are regulated to vary the combustion amount (step ST16). In this case, the rotating speed of the air-supplying fan 46 is accelerated to a high speed and the opening of the fuel control valve 42 is increased, thereby increasing the air and fuel supplying amounts to the combustion chamber 18*b* to increase the combustion amount.

However, when the combustion amount has already reached the maximum combustion amount ($C_E$) as at time $T_E$ shown in FIG. 4, the fuel-supplying valve 40*a* is turned on to start supply of fuel to the pulsating combustor 10*a* (step ST18). That is, the operation by both the pulsating combustors 10*a* and 10*b* is started. At this time, the rotating speed of the air-supplying fan 46 is decelerated to a low speed and the opening of the fuel control valve 42 is reduced, thereby making the combustion amounts of both the pulsating combustors 10*a* and 10*b* uniform (step ST19). In this manner, a continuous combustion variation is performed.

Figure 5:
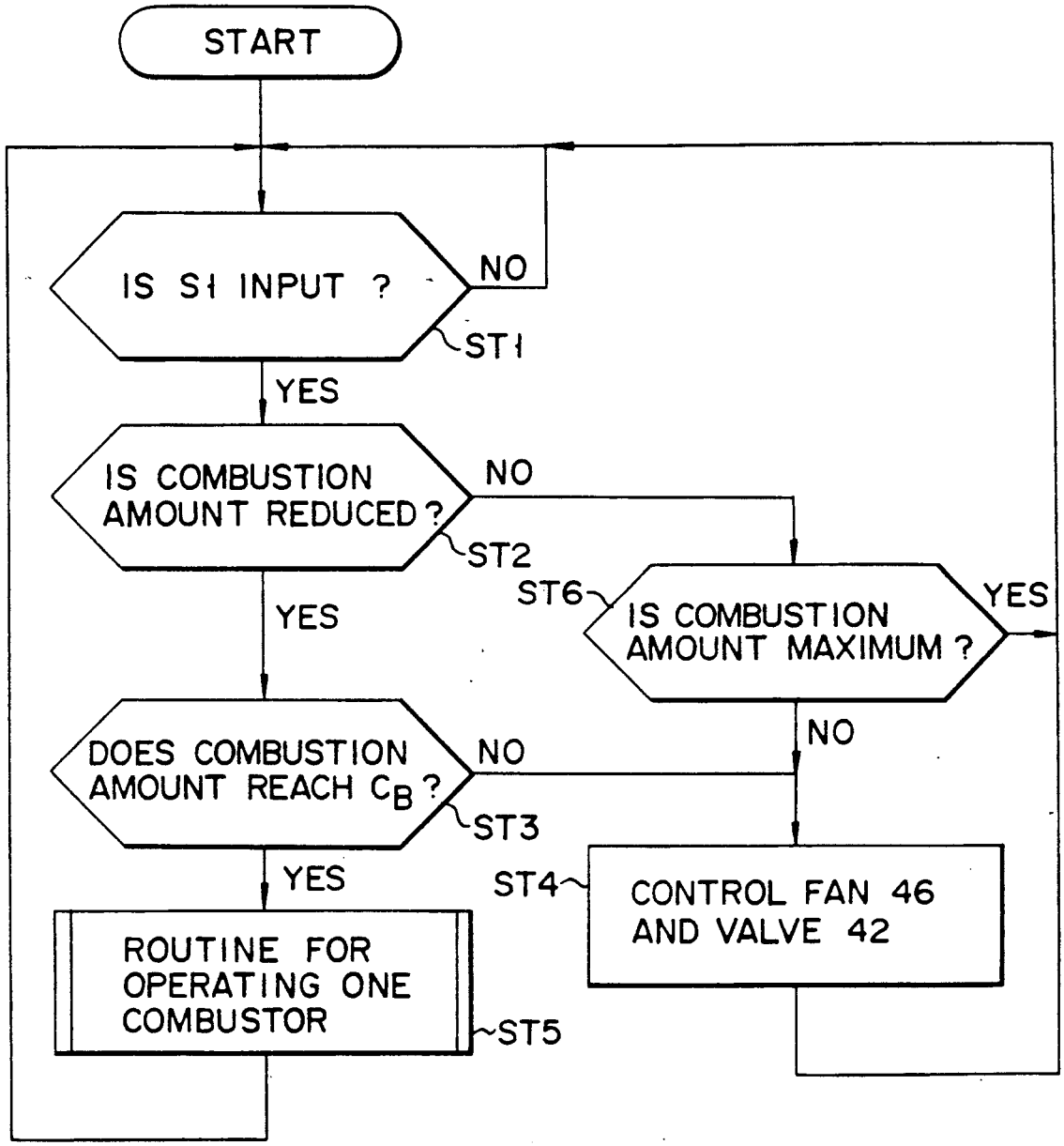
FIG. 5 is a flowchart of a combustion control unit for explaining the varying operation of the combustion amount.

Thereafter, the operation is returned to the operation shown in FIG. 5 as described above. Accordingly, when an operation command $S_1$ for varying the combustion amount is further input from the operation unit (step ST1), whether or not the operation command $S_1$ is a command for reducing the combustion amount or a command for raising the combustion amount is judged (step ST2). When the combustion amount is further raised, whether or not the present combustion amount reaches the maximum combustion amount (max) by the two pulsating combustors is judged (step ST6). If the combustion amount does not yet reach the maximum combustion amount, the rotating speed of the air-supplying fan 46 and the opening of the fuel control vale 42 are regulated to vary the combustion amount (step ST4). In this case, the rotating speed of the air-supplying fan 46 is accelerated to a high speed and the opening of the fuel control valve 42 is increased, thereby increasing air and fuel supplying amounts to increase the combustion amount.

In this manner, the combustion amount is increased in response to the command for increasing the combustion amount. For example, at time $T_F$ shown in FIG. 4, the combustion amount reaches the maximum combustion amount (max). Thereafter, since the combustion amount cannot be varied even if the command for increasing the combustion amount is further received, the command is ignored (step ST6).

Figure 7:
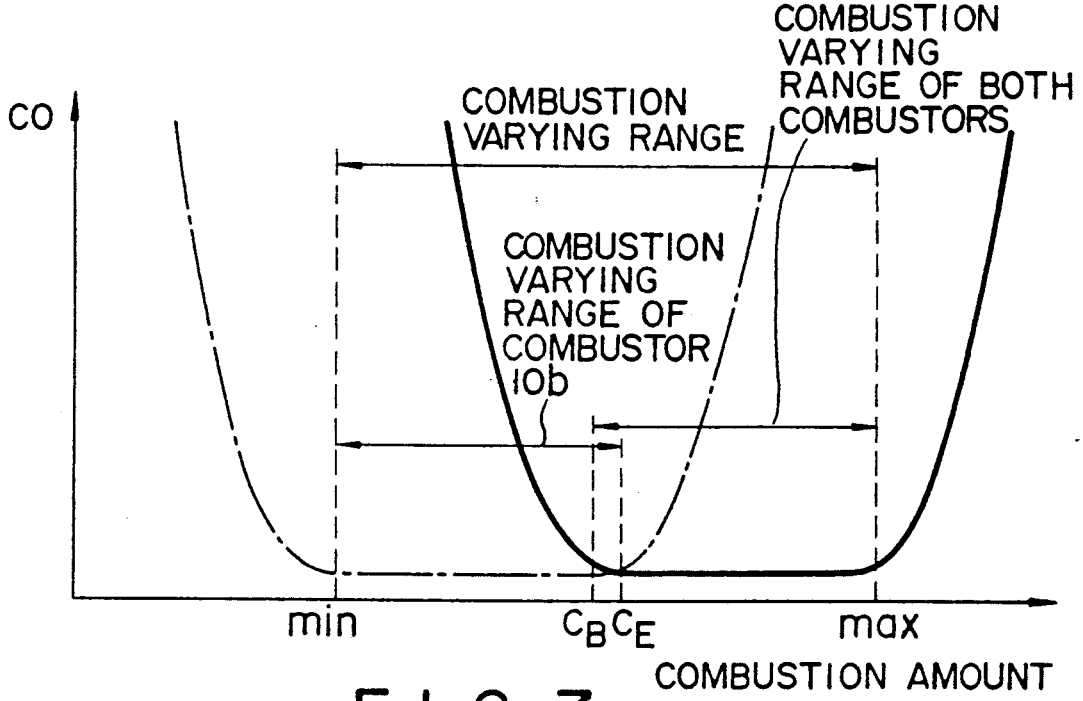
FIG. 7 is a state characteristic diagram of combustion varying range.

By the operation described above, as shown in the state characteristic diagram of the combustion varying range of the double-combustor type pulsating combustion apparatus according to a first embodiment of the present invention in FIG. 7, low combustion operation which cannot be obtained at the time of operation of both the pulsating combustors 10*a* and 10*b* can be carried out. That is, as shown, the combustion varying range can be increased as compared with that at the time of operation of both the pulsating combustors 10*a* and 10*b*.

With regard to noise, pressure interference by the reverse phase combustion cycle of both the pulsating combustors 10*a* and 10*b* as described above does not occur at the time of combustion of only one pulsating combustor 10*b*, but since a combustion load is decreased, noise is accordingly reduced. Further, the other pulsating combustor 10*a* which is not combusted performs a role of a muffler through the air-intake chamber 12 and the exhaust chamber 14. At this time, the pulsating combustor 10*a* which is not combusted becomes an ideal resonance type muffler. Accordingly, it is confirmed that an extremely low noise value ca be performed similarly to that at the time of combustion by the two pulsating combustors according to experiments.

As described above, the combustion by the one pulsating combustor is fundamentally different from the case that the two pulsating combustors are independently operated in parallel as described above to increase the capacity varying range at a point that both the pulsating combustors affect each other.

Figure 8:
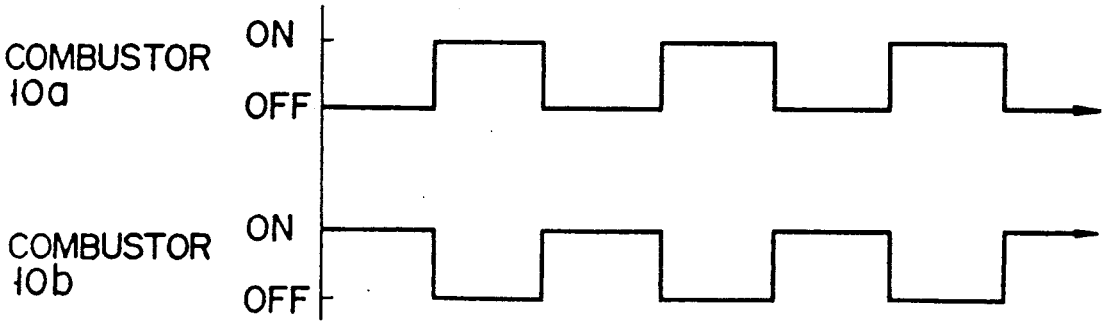
FIG. 8 is a operation characteristic diagram of a second embodiment of the present invention.

Next, a double combustor-type pulsating combustion apparatus according to a second embodiment of the present invention will be described with reference to the operation characteristic diagram in FIG. 8. In the case of the combustion control unit 48 at the time of combustion of one pulsating combustor in the first embodiment described above, as shown, the pulsating combustors operating for a predetermined period of time are exchanged. That is, when one pulsating combustor 10*a* is operated for a predetermined period of time, the pulsating combustor 10*a* is stopped, and the other pulsating combustor 10*b* is then operated. When the other pulsating combustor 10*b* is similarly operated for a predetermined period of time, it is stopped, and the one pulsating combustor 10*a* is then operated.

Both the pulsating combustors are controlled as described above to prevent the durability of both the pulsating combustors from decreasing due to the operation that either one pulsating combustor is operated for a long period of time.

According to the present invention as described above, when the combustion amounts of the double-combustor type pulsating combustion apparatus are desirably reduced, either one pulsating combustor is stopped to reduce the entire capacity by half to increase the varying range of the combustion amount whole holding an extremely low noise value.

Additional advantages and modifications will readily occur to those skilled in the art. Therefore, the invention in its broader aspects is not limited to the specific details, and representative devices, shown and described herein. Accordingly, various modifications may be without departing from the spirit or scope of the general inventive concept as defined by the appended claims and their equivalents.

What is claimed is:

1. A double-combustor type pulsating combustion apparatus comprising:

a first pulsating combustor including a first combustion chamber having a predetermined volume, for a series of combustions to occur within, a first tail pipe connected to a downstream side of said first combustion chamber, a first air-intake pipe for supplying air to said first combustion chamber, the first air-intake pipe being connected to an upstream side of said first combustion chamber, and a first fuel-supplying pipe indirectly connected to said first combustion chamber and having a first fuel supplying-valve located therein, for regulating the supply of fuel to said first combustion chamber;

a second pulsating combustor including a second combustion chamber having the predetermined volume, for a series of combustions to occur within, a second tail pipe connected to a downstream side of said second combustion chamber, a second air-intake pipe for supplying air to said second combustion chamber, the second air-intake pipe being connected to an upstream side of said second combustion chamber, and a second fuel-supplying pipe indirectly connected to the second combustion chamber and having a second fuel-supplying valve located therein, for regulating the supply of fuel to said second combustion chamber, the second pulsating combustor operating at a combustion cycle whose phase is opposite to that of said first pulsating combustor; and means for controlling said first and second pulsating combustors, for closing said first fuel-supplying valve when total quantity of air and fuel supplied to the first and second combustion chambers for two consecutive combustions, one combustion in said first combustion chamber and the other combustion in said second combustion chamber, is less than ½ of the maximum quantity of air and fuel allowed to be supplied to said first and second combustion chambers for the two consecutive combustions and for opening said first fuel-supplying valve, when in closed condition, when the total quantity of air and fuel supplied to said second combustion chamber for a combustion becomes greater than ½ of the maximum quantity of air and fuel allowed to be supplied to said first and second combustion chambers for two consecutive combustions, one combustion in said first combustion chamber and the other combustion in said second combustion chamber.

2. An apparatus as in claim 1, further comprising:

means for connecting said first and second tail pipes to each other; and means for connecting said first and second air-intake pipes to each other.

3. An apparatus as in claim 2, wherein said control means comprises means for (1) opening said first fuel-supplying valve and closing said second fuel-supplying valve, (2) closing said first fuel-supplying valve and opening said second fuel-supplying valve and (3) alternately carrying out (1) and 2), above at regular intervals of time during which total quantity of air and fuel supplied to one of said first and second combustion chambers for a combustion is less than ½ of the maximum quantity of air and fuel allowed to be supplied to said first and second combustion chambers for two consecutive combustions.

4. An apparatus as in claim 2, wherein said control means comprises means for varying the opening degree of said second fuel-supplying valve during which said first fuel-supplying valve is closed.

5. An apparatus as in claim 2, wherein said control means comprises means for regulating the degree of openings of said first and second fuel-supplying valves during which both of said first and second fuel-supplying valves are open.

6. An apparatus as in claim 2, wherein said control means comprises means for reducing quantity of air and fuel supplied to at least one of said first and second combustion chambers by regulating the degree of openings of at least one of said first and second fuel-supplying valves.

7. A double combustor type pulsating combustion apparatus, comprising:

a pair of pulsating combustors connected to each other for performing pulsating combustions in reverse phase; and means for controlling said pair of pulsating combustors by regulating quantity of air supplied to said combustors in proportion to the amount of fuel supplied to said pair of pulsating combustors, said controlling means including means for stopping combustion of one pulsating combustor when quantity of air and fuel being supplied to said combustors becomes less than a predetermined amount, and supplying fuel and air only to the other pulsating combustor.

8. An apparatus as in claim 7, further comprising:

means for connecting said pair of pulsating combustors at their upstream and downstream sides.

9. An apparatus as in claim 7, wherein said controlling means comprises means for alternately driving each of the pulsating combustors at regular time intervals during which the quantity of air and fuel being supplied to said combustors is less than said predetermined amount.

* * * * *